US009099802B2

(12) United States Patent
Beharrell

(10) Patent No.: US 9,099,802 B2
(45) Date of Patent: Aug. 4, 2015

(54) MODULAR ELECTRICAL APPARATUS

(71) Applicant: Wes Beharrell, London (CA)

(72) Inventor: Wes Beharrell, London (CA)

( * ) Notice: Subject to any disclaimer, the term of this patent is extended or adjusted under 35 U.S.C. 154(b) by 32 days.

(21) Appl. No.: 14/200,517

(22) Filed: Mar. 7, 2014

(65) Prior Publication Data

US 2014/0308844 A1 Oct. 16, 2014

Related U.S. Application Data

(60) Provisional application No. 61/810,553, filed on Apr. 10, 2013.

(51) Int. Cl.

| | |
|---|---|
| ***H01R 13/514*** | (2006.01) |
| ***H01R 24/78*** | (2011.01) |
| ***H01R 31/02*** | (2006.01) |

(52) U.S. Cl.

CPC ..... *H01R 13/514* (2013.01); *H01R 24/78* (2013.01); *H01R 31/02* (2013.01)

(58) Field of Classification Search

CPC .. H01R 13/514; H01R 13/5213; H01R 24/78; H01R 31/02

USPC ..... 439/521, 502, 503, 505

See application file for complete search history.

(56) References Cited

U.S. PATENT DOCUMENTS

| | | | | |
|---|---|---|---|---|
| 2,397,688 | A | 4/1944 | Osinski | |
| 5,238,424 | A | 8/1993 | Vindum | |
| 7,210,960 | B2 | 5/2007 | Mak | |
| 7,247,954 | B1 | 7/2007 | Dowdle | |
| 8,292,657 | B2 | 10/2012 | Singh | |
| 2010/0078190 | A1* | 4/2010 | Leopold | 174/50.52 |
| 2010/0328953 | A1* | 12/2010 | Wu | 362/249.14 |
| 2012/0220164 | A1 | 8/2012 | Flynn | |
| 2014/0065886 | A1* | 3/2014 | Lee | 439/628 |
| 2015/0038019 | A1* | 2/2015 | Lee et al. | 439/640 |

* cited by examiner

*Primary Examiner* — Tulsidas C Patel
*Assistant Examiner* — Marcus Harcum
(74) *Attorney, Agent, or Firm* — Daniel Boudwin; Global Intellectual Property Agency LLC

(57) ABSTRACT

A modular electrical apparatus is provided. The present modular apparatus consists of four separate interchangeable electrical fixtures that can be connected together to form a single device that provides outlets and light sources to locations that often lack wired electrical connections, such as outdoor sheds. The user can connect any number of the various electrical fixtures together in any order, allowing users to fully customize the present invention based upon their needs.

10 Claims, 9 Drawing Sheets

MODULAR ELECTRICAL APPARATUS

CROSS REFERENCE TO RELATED APPLICATION

This application claims the benefit of U.S. Provisional Application No. 61/810,553 filed on Apr. 10, 2013. The above identified patent application is herein incorporated by reference in its entirety to provide continuity of disclosure.

BACKGROUND OF THE INVENTION

1. Field of the Invention

The present invention relates to electrical power distribution. More specifically, the present invention relates to modular electrical apparatuses.

Certain areas, such as sheds, outbuildings, buildings under construction, and other temporary or semi-permanent structures, often lack electrical outlets. If individuals want to power electrical devices that require a wired electrical connection in these locations, they must run new electrical wiring to the desired area or use extension cords, power strips, or a combination thereof. Running new electrical wiring and installing new outlets is a dangerous task if one does not have the proper training. If one chooses to instead pay an electrician to perform the task, then the project can quickly become quite expensive. On the other hand, using extension cords and power strips to extend outlets to a remote location that lacks outlets can create a substantial amount of clutter and can be difficult to organize adequately. Therefore, there is a need for an inexpensive, easily installed, and organized system of providing electrical outlets to remote locations.

Portable, rechargeable electrical devices having outlets are known in the prior art. These devices can be used to power electrical devices, which require wired connections to run, in locations remote from an electrical outlet. However, these devices can run out of power very quickly, depending on the number and types of devices connected thereto. Also, it can be very inconvenient to have to constantly recharge these devices. Power strips having means to organize connected wires are also known in the prior art. These devices allow users to keep their cords together in an organized fashion, reducing clutter. However, these devices provide only a set amount of electrical outlets and do not provide additional features, such as light sources.

A novel modular electrical apparatus is provided. The present invention is designed to provide outlets and light sources to locations that generally lack electrical outlets, such as outdoor sheds, in an organized and convenient manner. The present modular electrical apparatus comprises four different modules: an exterior transition fixture, a switch fixture, an outlet fixture, and a light fixture, which may be interchangeably connected in series together. These fixtures may be either directly connected together or connected together in a spaced apart manner using extension cords. The exterior transition fixture contains a three-prong plug that can be connected from the outdoor shed, or other location, to an outlet (or other direct power source), thereby providing power to any modules or other devices connected thereto. The orientation, shape, number, and type of modules used can be customized so that the user can fashion the present invention as he or she wishes.

2. Description of the Prior Art

Devices have been disclosed in the prior art that relate to portable electrical power systems or power cords having additional sockets. These include devices that have been patented and published in patent application publications. These devices generally relate to electrical outlet apparatuses in which one or more components are interchangeable. The following is a list of devices deemed most relevant to the present disclosure, which are herein described for the purposes of highlighting and differentiating the unique aspects of the present invention, and further highlighting the drawbacks existing in the prior art.

One such device is U.S. Pat. No. 2,397,688 to Osinski, which discloses an electrical box wherein plugs or switches may be easily swapped out of the device without altering any of the existing wiring. The present invention also offers a modular design wherein switches and plugs may be easily swapped out or added to the apparatus, however the modules of the present invention are designed to be used in conjunction with and in parallel to each other, rather than merely plugging into a single electrical outlet box.

Other such devices include U.S. Pat. No. 5,238,424 to Vindum and U.S. Pat. No. 7,210,960 to Mak, which both disclose an extension cord that has one or more sockets disposed along its length. The device effectively provides sockets through the length of the cord, rather than only at the end of the cord. The present invention also has sockets disposed along the length of a connecting cord, however the sockets of the present invention are provided in a housing that is freely removable from the present electrical apparatus. Furthermore, the present invention provides numerous other modules in addition to sockets, including switch and light fixture modules.

Another such device is U.S. Pat. No. 7,247,954 to Dowdle, which discloses a system for providing cordless remote electrical power, comprising a portable, rechargeable electrical storage device that is designed to couple with conventional electrical plugs. The present invention is also designed to provide electrical power to areas that ordinarily lack electrical outlets, however the present invention comprises a plurality of swappable modules including light fixtures, outlets, and switches, creating a more comprehensive electrical power system.

Both U.S. Pat. No. 8,292,657 to Singh and Published U.S. Patent Application Publication No. 2012/0220164 to Flynn disclose a portable, rechargeable electrical outlet box to provide power to devices at locations lacking an outlet. The present invention comprises multiple modular electrical fixtures that are connected to an outlet via an extension cord, which can be extended to a shed, basement, or other similar location in an organized fashion. The modular fixtures of the present invention are swappable and easily connected together, thereby allowing a user to provide power to said location in an organized fashion, but the present invention is not itself a rechargeable independent source of power.

A novel modular electrical apparatus is provided. The present invention comprises a modular system of electrical fixtures that is fully customizable based upon the user's preferences. The present invention provides users with a means for providing power to areas lacking electrical outlets in an organized fashion that does not require an electrician. It substantially diverges in design elements from the prior art and consequently it is clear that there is a need in the art for an improvement to existing modular electrical outlet devices. In this regard the instant invention substantially fulfills these needs.

SUMMARY OF THE INVENTION

In view of the foregoing disadvantages inherent in the known types of modular electrical outlet apparatuses now present in the prior art, the present invention provides a new modular electrical apparatus wherein the same can be utilized for providing convenience for the user when seeking to provide power to a remote area in an organized fashion.

It is therefore an object of the present invention to provide a new and improved modular electrical apparatus that has all of the advantages of the prior art and none of the disadvantages.

It is another object of the present invention to provide a modular electrical apparatus that is capable of providing outlets and light sources to a location that lacks electrical outlets, such as an outdoor shed, in a convenient and organized fashion.

It is another object of the present invention to provide a modular electrical apparatus that allows users to freely remove and swap out the various provided fixtures.

Another object of the present invention is to provide a modular electrical apparatus that provides users with multiple outlets.

Another object of the present invention is to provide a modular electrical apparatus that comprises multiple separate fixtures having separate components.

Another object of the present invention is to provide a modular electrical apparatus that is mountable to a wall or another surface.

Yet another object of the present invention is to provide a modular electrical apparatus that includes a means for protecting a portion of the apparatus that extends outwardly from a structure from the elements.

Yet another object of the present invention is to provide a modular electrical apparatus that is capable of powering a variety of devices, including a light bulb.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
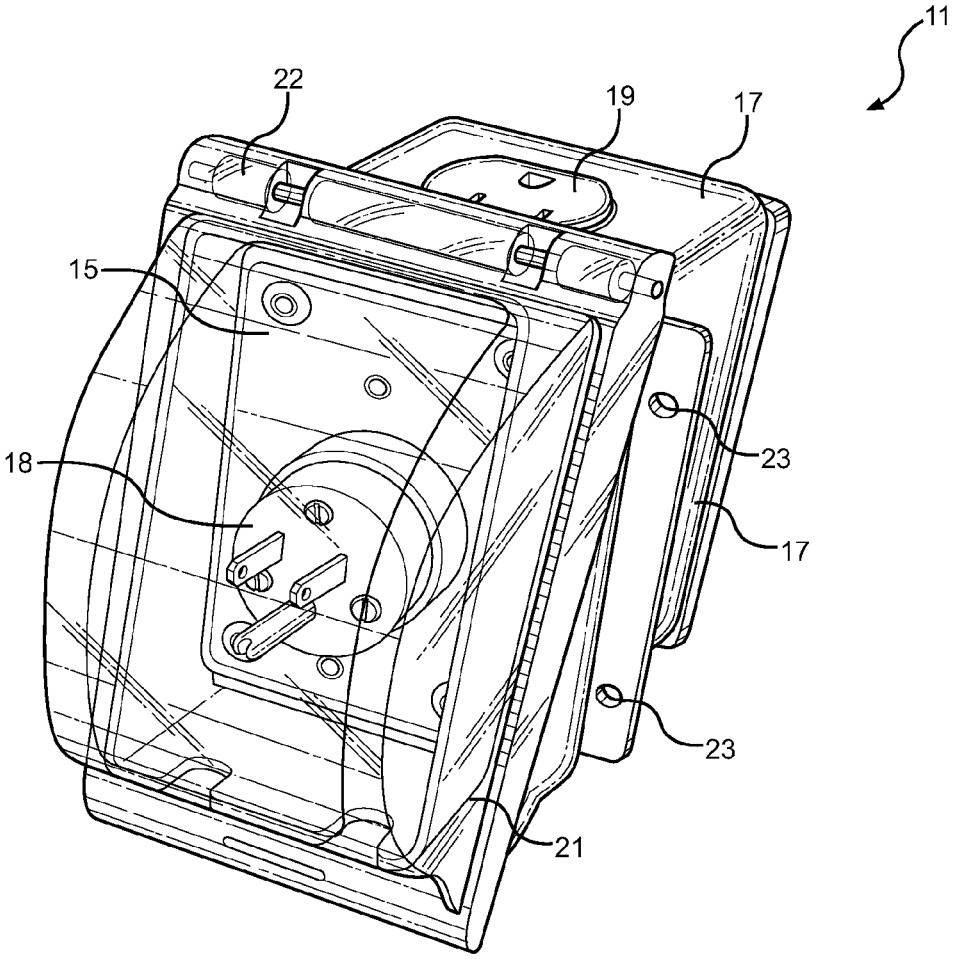
FIG. 1 shows a perspective view of the front of the exterior transition fixture of the present invention.

Reference is made herein to the attached drawings. Like reference numerals are used throughout the drawings to depict like or similar elements of the modular electrical apparatus. For the purposes of presenting a brief and clear description of the present invention, the preferred embodiment will be discussed as used for providing electrical outlets to sheds or other semi-permanent or temporary structures. The figures are intended for representative purposes only and should not be considered to be limiting in any respect.

The present modular electrical fixture apparatus provides a device that allows individuals to place electrical outlets in locations that often lack such outlets, such as semi-permanent or temporary structures, in an organized and easily installed fashion. The present invention comprises four separate modular components that may be freely attached and detached from each other, forming a single apparatus. The modular components of the present invention include an exterior transition fixture, an outlet fixture, a switch fixture, and a light fixture. The present modularized device allows users to mix and match electrical fixture components in order to create a customized electrical appliance or circuit that is capable of providing power and other features to locations that lack wired electrical connections. The need for multiple extension cords and power strips is reduced because the present invention provides all of the components that an individual would need to power devices in an easily connected form.

Figure 2:
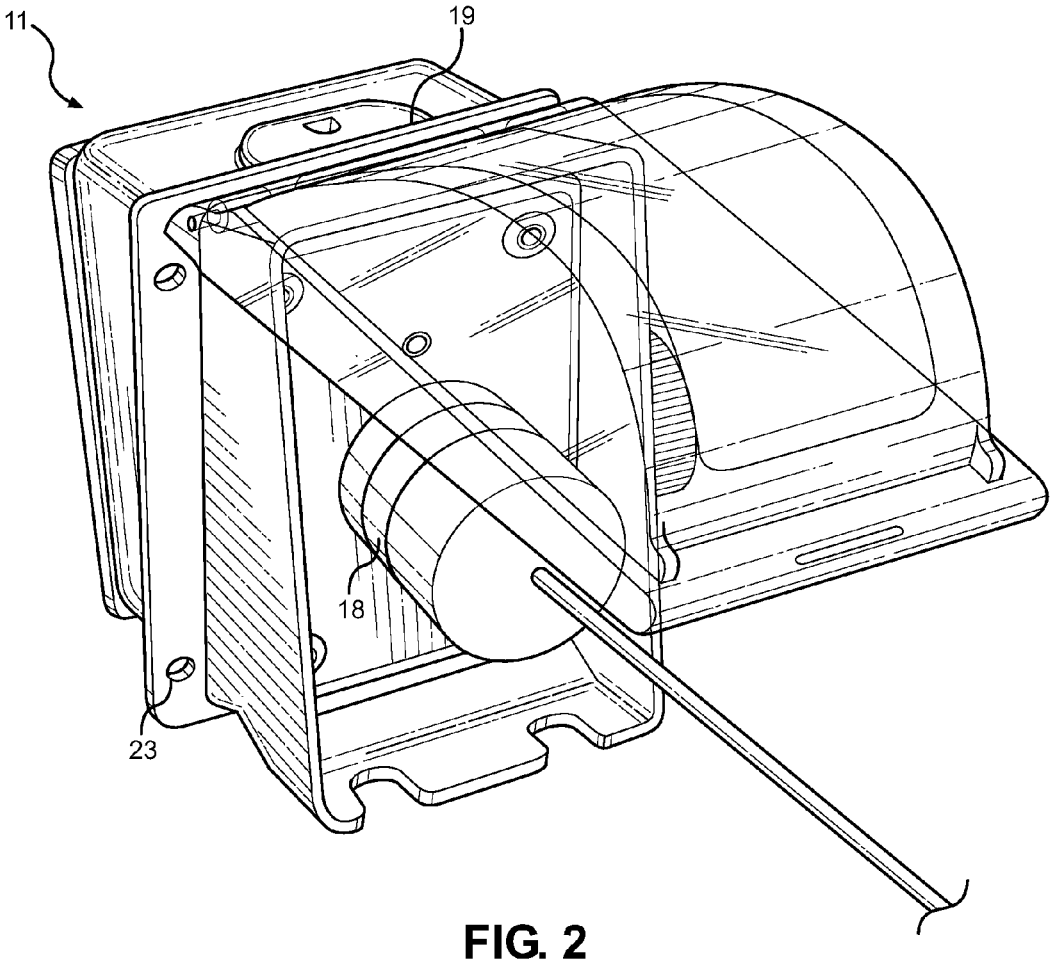
FIG. 2 shows a perspective view of the front of the exterior transition fixture of the present invention with an extension cord connected thereto.
Figure 3:
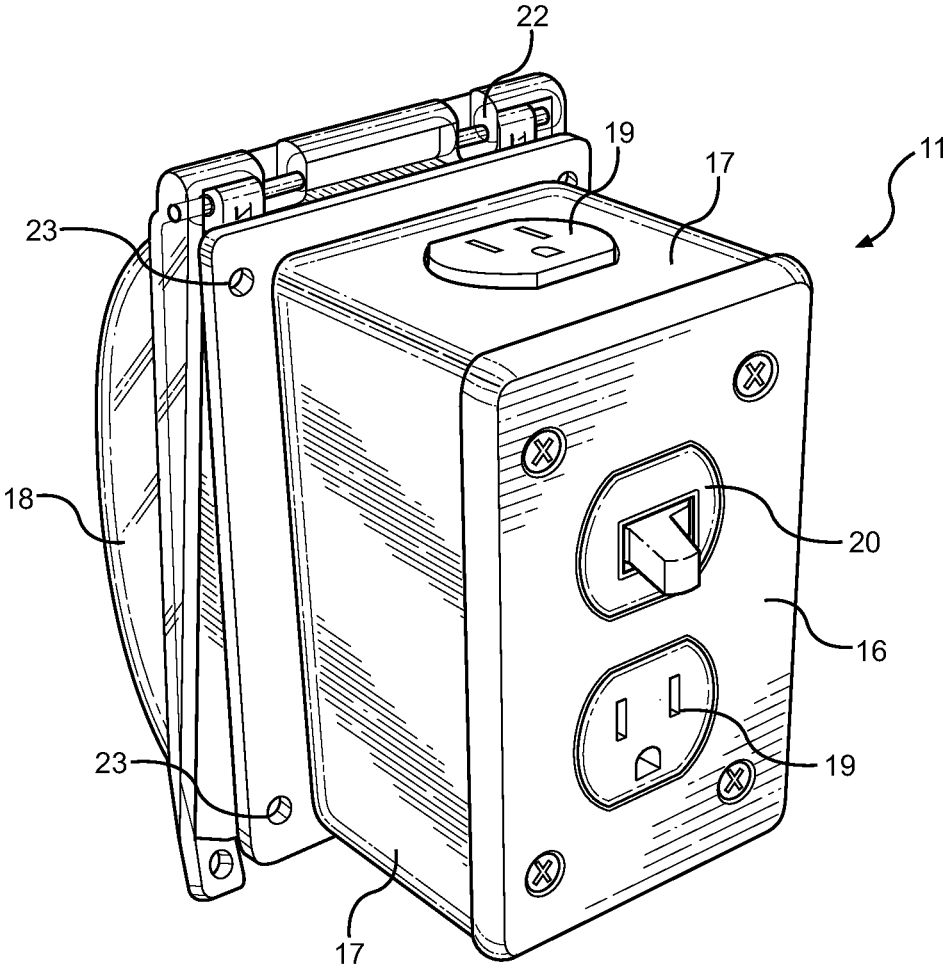
FIG. 3 shows a perspective view of the back of the exterior transition fixture of the present invention.

Referring now to FIGS. 1, 2, and 3, there are shown perspective views of the exterior transition fixture of the present invention. The exterior transition fixture 11 comprises at least one sidewall 17, a front face 15, and a back face 16, which together define a housing. A plug 18 is disposed on the front face 15 of the housing. A switch 20 is disposed on the back face 16 of the housing, extending oppositely from said housing in relation to said extendable plug 18. The exterior transition fixture 11 further has a plurality of outlets 19 disposed across the housing. In the depicted embodiment there are outlets 19 located on the top sidewall 17 surface, the bottom sidewall 17 surface, and the back face 16. However, no claim is made as to the exact number and distribution of outlets 19 across the exterior transition fixture 11 housing.

A weatherproof cover 21 is connected to the front face 15 of the exterior transition fixture 11 via a hinge 22. The hinged connection 22 allows the weatherproof cover 21 to transition between a raised position where the plug 18 is exposed and may be withdrawn therefrom and a lowered position where the plug 18 is protected from the elements. In FIG. 1, the present exterior transition fixture is depicted with the weatherproof cover 21 in the lowered position and in FIG. 2 the weatherproof cover 21 is depicted in the raised position. The weatherproof cover 21 is preferably made from a hard, waterproof material and forms a seal sufficient to keep external water from coming in contact with the extendable plug 18 when the weatherproof cover 21 is in the lowered position. In use, the exterior transition fixture 11 is affixed to a wall of the shed or other exterior location with the front face 15 on the exterior of the location. The plug 18 may then be connected to a remote electrical power source via an extension cord, energizing the exterior transition fixture 11 and any other fixtures or other devices connected thereto.

The exterior transition fixture 11 provides a modularized means for easily adding electrical outlets to a remote location that lacks wired electrical connections, such as an outdoor shed. In the preferred embodiment, the exterior transition fixture 11 has a fastening means 23 disposed on the housing of the device so the device can be secured to a wall. The device is designed so that it can be fastened to the wall of a location such as a shed, with the front face 15 on the exterior of the location and the back face 16 within the interior of the location. The fastening means 23 preferably comprises a lip or flange extending around the perimeter of the sidewalls 17, separating the exterior transition fixture 11 into an exterior potion having the plug 18 and the weatherproof cover 21 and an interior portion having the plurality of outlets 19 and the switch 20 disposed thereon. The fastening means 23 thereby acts as a seal around the edge of the aperture through which the exterior transition fixture 11 is placed, thereby preventing the elements from reaching the interior of the semi-permanent or temporary structure to which the exterior transition fixture 11 is affixed. Furthermore, the fastening means 23 comprises a plurality of apertures or tapped apertures, which may be used to secure the exterior transition fixture 11 to a wall or another surface. The plug 18 can then be connected to an outlet in a remote location, such as a nearby house, via an extension cord, thereby reversibly powering the present invention. Additional modularized fixtures can be attached to the interior outlets 19 on the back face 16 of the present exterior transition fixture 11, allowing the user to add additional features, such as switches or additional outlets, in an easy-to-use manner that does not require any knowledge of electrical wiring.

The exterior transition fixture 11 is depicted as roughly rectangular in shape, but no claim is made as to the specific shape of the housing of the various modules of the present invention. The modules of the present invention are preferably designed such that they can easily be connected together in a series, whether directly together via engagement between complementary connection plugs 24 and outlets 25 or in a spaced apart manner via extension cords. The outlets 19 of the exterior transition fixture 11 have a conventional three-prong design that allows them to connect to conventional plugs. The extendable plug 18 also has a conventional three-pin design that allows it to engage with corresponding conventional outlets.

Figure 4:
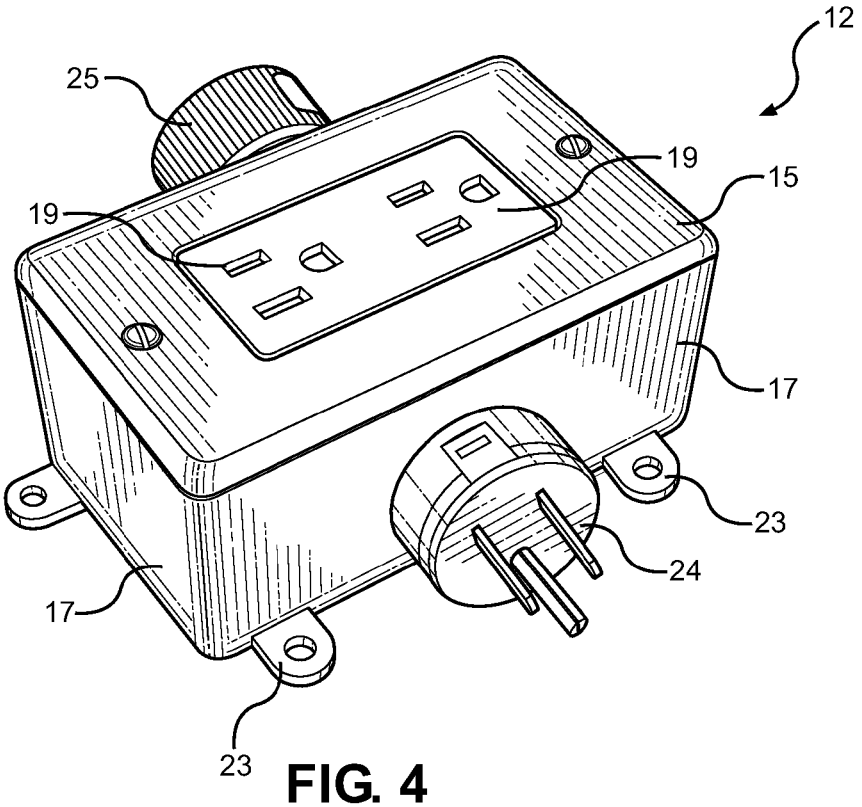
FIG. 4 shows a perspective view of the outlet fixture of the present invention.

Referring now to FIG. 4, there is shown a perspective view of the outlet fixture of the present invention. The outlet fixture 12 module comprises at least one sidewall 17, a front face 15, and a back face that together define a housing. The outlet fixture 12 is depicted as having four sidewalls 17 and as having a roughly rectangular shape, but no claim is made as to the exact shape of the device. At least one connection plug 24 is disposed on said sidewalls 17 for engaging with a complementary connection outlet 25 on a complementary module of the present invention. Similarly, at least one connection outlet 25 is disposed on said sidewalls 17 for engaging with a complementary connection plug 24 on a complementary module. The outlet fixture 12 is designed as a module that can be easily connected to other modules of the present invention to form a single electrical apparatus. As opposed to the exterior transition fixture 11, the fastening means 23 disposed on the other fixtures may comprise tapped tabs, rather than a lip or flange extending around the perimeter of the fixture with tapped apertures.

The present outlet fixture 12 has a plurality of outlets 19 disposed on its front face 15. The outlet fixture 12 can be connected to the exterior transition fixture 11 via the outlet fixture's 12 connection plug 24. If the exterior transition fixture 11 is in turn connected to a power supply, then the outlet fixture 12 can draw power therethrough and power devices that are plugged into the outlet fixture 12. The outlet fixture 12 otherwise functions as a conventional outlet. The device further has a fastening means 23 disposed on the housing so that the outlet fixture 12 can be attached to a wall. The fastening means 23 may include any manner of attachment, including a plurality of threaded members welded onto the housing that can have a screw secured therethrough to attach the present outlet fixture 12 to a wall.

Figure 5:
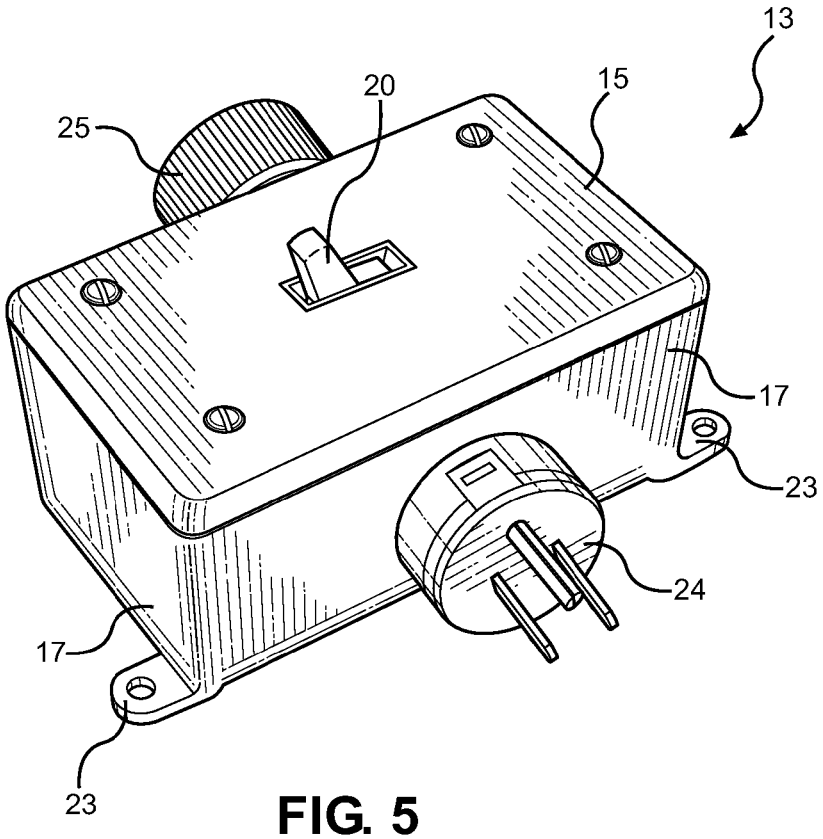
FIG. 5 shows a perspective view of the switch fixture of the present invention.

Referring now to FIG. 5, there is shown a perspective view of the switch fixture of the present invention. The switch fixture 13 module comprises at least one sidewall 17, a front face 15, and a back face that together define a housing. The switch fixture 13 is depicted as having four sidewalls 17 and as having a roughly rectangular shape, but no claim is made as to the exact shape of the device. At least one connection plug 24 is disposed on said sidewalls 17 for engaging with a complementary connection outlet 25 on a complementary module of the present invention. Similarly, at least one connection outlet 25 is disposed on said sidewalls 17 for engaging with a complementary connection plug 24 on a complementary module. The outlet fixture 12 is designed as a module that can be easily connected to other modules of the present invention to form a single electrical apparatus.

The switch fixture 13 has a switch 20 disposed on its front face 15. When the switch fixture 13 is connected to other modules via the connection plugs 24 and connection outlets 25, the switch fixture 13 can be used to toggle any connected devices and modules on and off. In an alternate embodiment, the switch 20 may further comprise a means for selectively turning particular connected devices and modules on and off, rather than acting as a blanket on/off switch. The device further has a fastening means 23 disposed on the housing so that the outlet fixture 12 can be attached to a wall. The switch 20 of the switch fixture 13 may act as a secondary, or additional means, for controlling the influx of power through the various fixtures connected in series, along with the switch 20 disposed on the exterior transition fixture. The fastening means 23 may include any manner of attachment, including a plurality of threaded members welded onto the housing that can have a screw secured therethrough to attach the present outlet fixture 12 to a wall.

Figure 6:
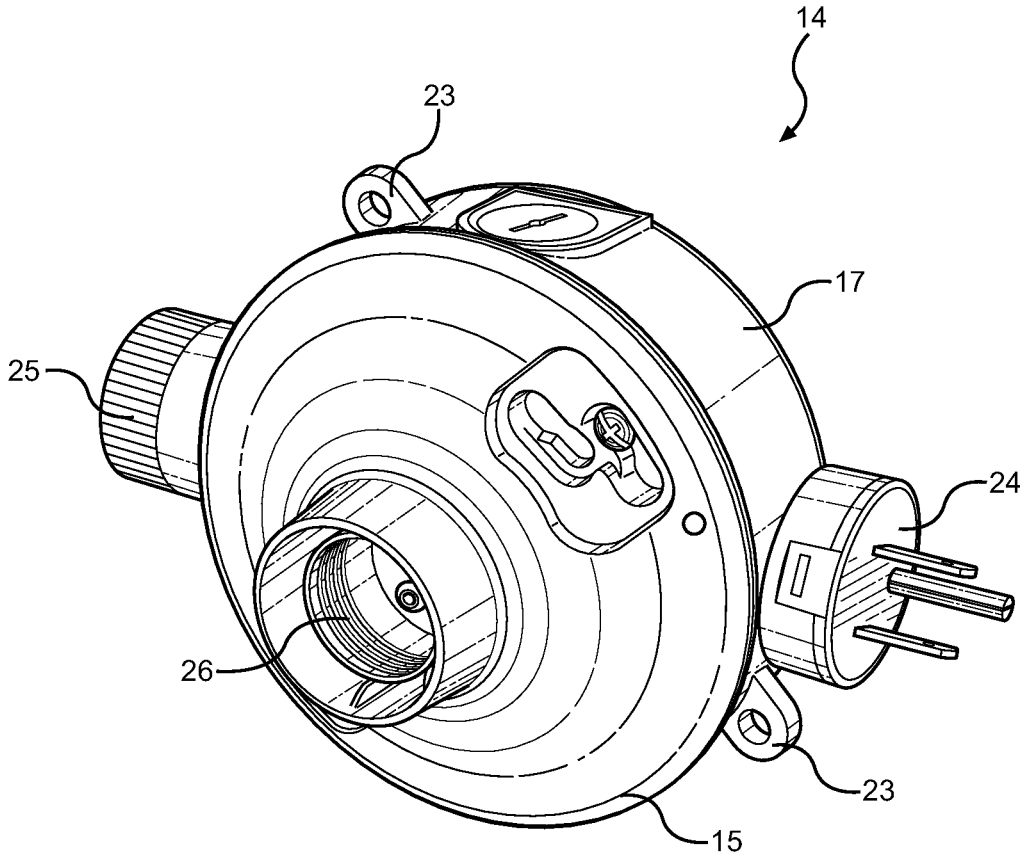
FIG. 6 shows a perspective view of the light fixture of the present invention.

Referring now to FIG. 6, there is shown a perspective view of a light fixture of the present invention. The light fixture 14 module comprises at least one sidewall 17, a front face 15, and a back face that together define a housing. The light fixture 14 is depicted as having a single cylindrical sidewall 17 and a sloped, curved, vertically-extending front face 15, but no claim is made as to the specific shape or configuration of the present light fixture 15. At least one connection plug 24 is disposed on said sidewall 17 for engaging with a complementary connection outlet 25 on a complementary module of the present invention. Similarly, at least one connection outlet 25 is disposed on said sidewalls 17 for engaging with a complementary connection plug 24 on a complementary module. The light fixture 14 is designed as a module that can be easily connected to other modules of the present invention to form a single electrical apparatus.

The light fixture 14 has a light bulb engagement means 26 disposed on said front face 15. Said bulb engagement means 26 comprises a threaded portion that is designed to engage with a complementary threaded portion on a light bulb. Any type of light bulb may be used with the light fixture module 14. A switch on either the exterior transition module or the switch fixture controls the energization of a light bulb connected to the light fixture module 14.

Figure 7:
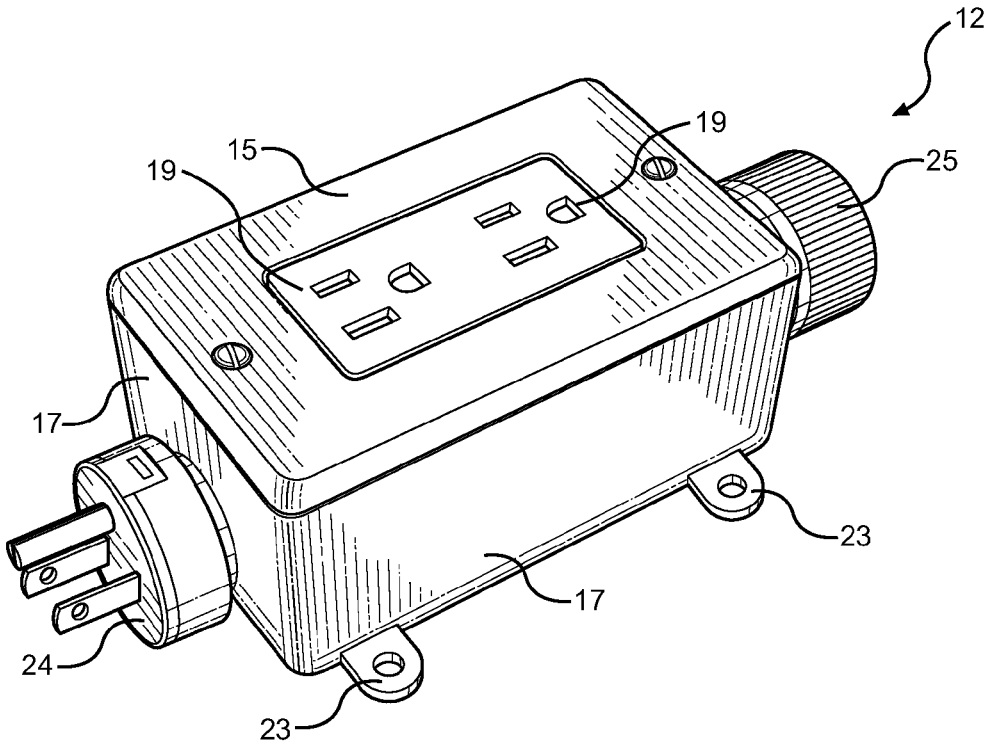
FIG. 7 shows a perspective view of an alternate embodiment of the outlet fixture of the present invention.
Figure 8:
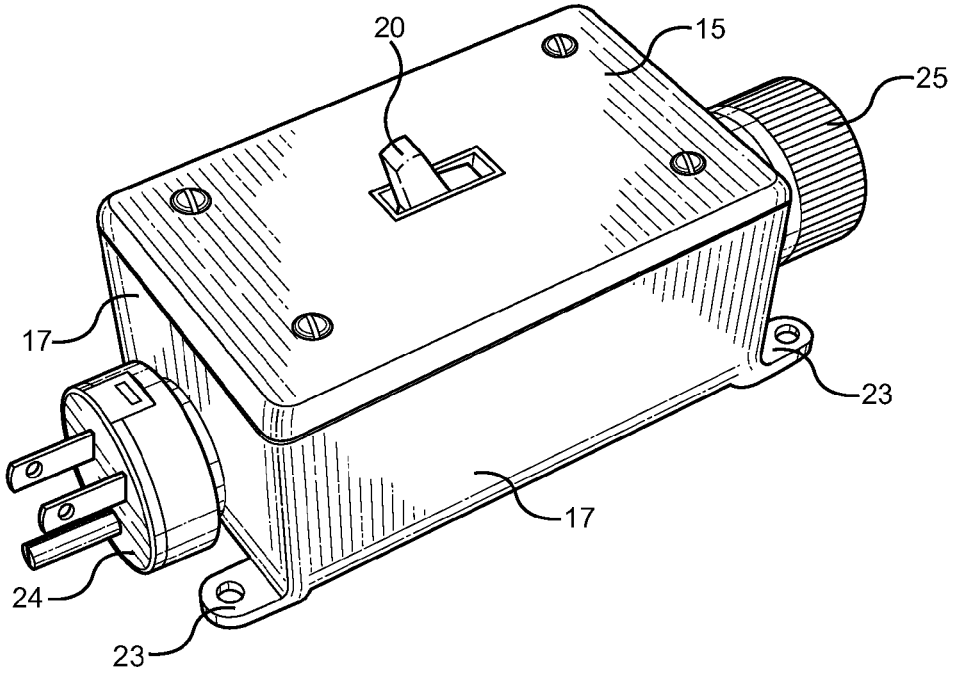
FIG. 8 shows a perspective view of an alternate embodiment of the switch fixture of the present invention.

Referring now to FIGS. 7 and 8, there are shown alternate embodiments of the outlet fixture and the switch fixture. In the previously depicted embodiments, the connection plug 24 and the connection outlet 25 were disposed on the elongated sidewalls 17, which allows the various modules of the present invention to be connected in a side-to-side manner. In alternate embodiments of the present invention, as depicted, the connection plug 24 and connection outlet 25 can be disposed on the ends of the modules, allowing the various modules of the present invention to be connected in an end-to-end manner. These different configurations of the connection plugs 24 and connection outlets 25 allows users to fully customize the positioning and orientation of the present invention when multiple modules are connected in series, thereby allowing users to accommodate the present invention to rooms or other spaces having different layouts. The alternative embodiments depicted in FIGS. 7 and 8 are otherwise are otherwise identical to the embodiments depicted in FIGS. 4 and 5, wherein the modules have a front face 15, at least one sidewall 17, at least one outlet 19 or a switch 20 disposed on the front face 15, and preferably a fastening means 23 disposed on their housing.

Figure 9:
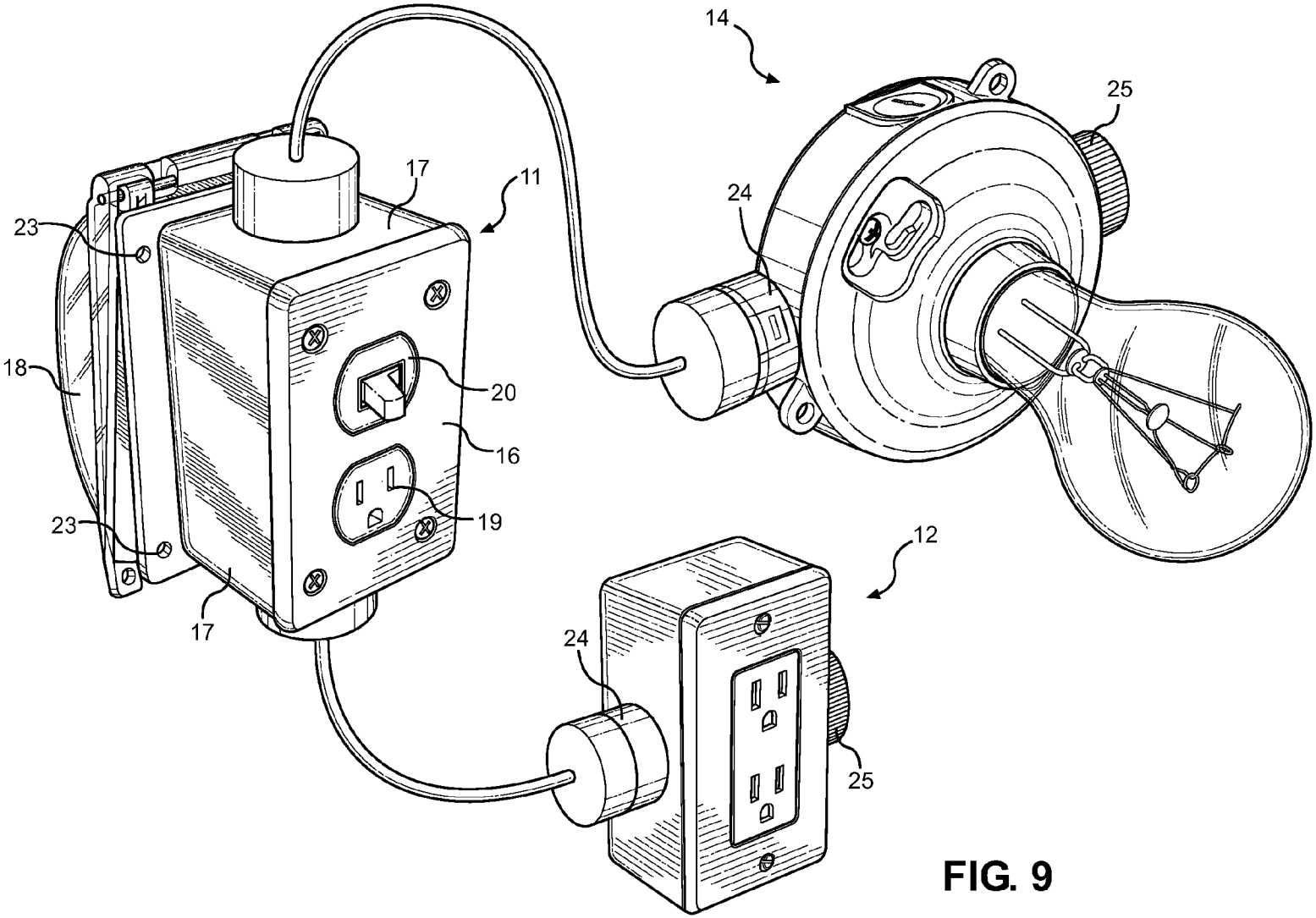
FIG. 9 shows a perspective view of various modular fixtures of the present invention connected together in series via a plurality of extension cords.
Figure 10:
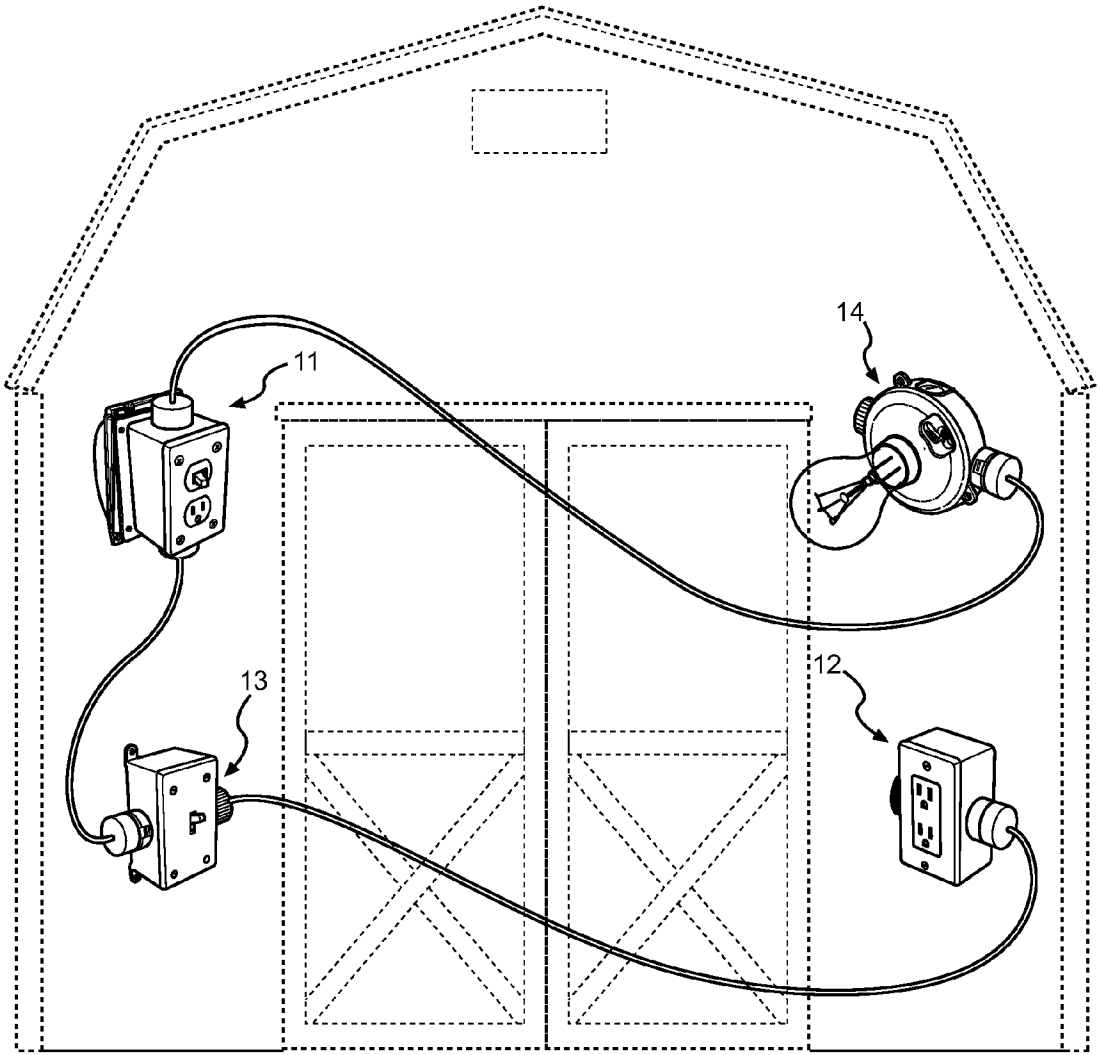
FIG. 10 shows a perspective view of alternate embodiments of all of the modular fixtures of the present invention connected in a series and disposed about a temporary structure.
Figure 11:
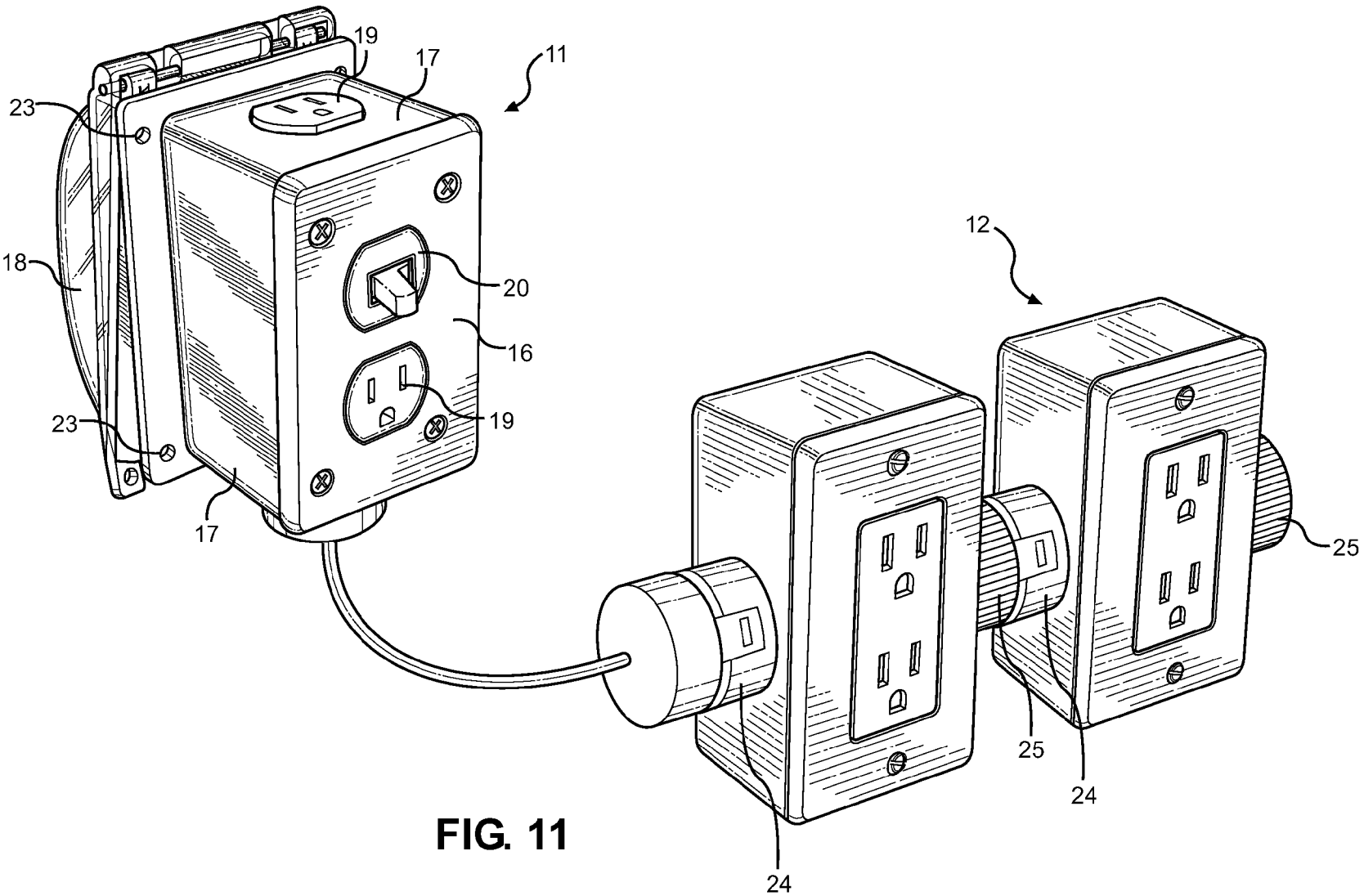
FIG. 11 shows a perspective view of the electrical transition fixture connected via an extension cord to a plurality of outlet fixtures, which are connected together directly.

Referring now to FIGS. 9, 10, and 11, there are shown perspective views of various embodiments of various modular fixtures of the present invention connected in a series to form a single apparatus. The connection plug 24 and connection outlet 25 members are universal between the exterior transition fixture 11, outlet fixture 12, light fixture 14, and switch fixture 13 modules, allowing the different modules to be interchanged when connected in a series. Modules of the present invention can either be excluded from the electrical apparatus, as shown in FIG. 9, or repeated, as shown in FIG. 11. In FIG. 9 the switch fixture 19 is excluded from the apparatus. In FIG. 11, the outlet fixture 12 is repeated, increasing the number of usable outlets available to the user. This allows users to fully customize the device they create so that its size, shape, and function ideally match the user's needs.

The various modules may be connected together either directly, via direct engagement between their plugs and outlets, or may be connected together via a series of extension cords, as seen in FIG. 9, or may be connected by some combination of the two methods of connection, as seen in FIG. 11. As depicted in FIG. 10, the various modules of the present modular electrical apparatus are designed to be situated about a temporary or semi-permanent structure to provide power, light, outlets, and means for controlling said features in an organized, efficient, and easily customizable manner.

The present invention is designed to provide electrical outlets and light sources to areas that generally do not have wired electrical connections, such as outdoor sheds, in a convenient and customizable fashion. The exterior transition fixture 11 is generally affixed to a wall of the outdoor or remote location such that the front face faces externally from the shed, building, or other location so that the extendable plug 18 can be extended therefrom and connected to a distant outlet, providing power to the entire device. The back face of the exterior transition fixture faces inwardly, allowing users inside the outdoor shed, building, or other location to use the switch and outlets disposed thereon and also connect other modules to the exterior transition fixture 11. The exterior transition fixture 11 is preferably mounted through a pre-cut hole in the outdoor shed wall. The exterior transition fixture 11, and the other modules of the present invention, are affixed to the walls of the outdoor shed or other external location via the fastening means 23, which are disposed on the housing of the various modules. The fastening means 23 generally comprise tabs having apertures, which allows screws or nails to be affixed to the wall therethrough and therefore hold the present invention securely against the wall of the outdoor shed or other external location. However, no claim is made as to the specific structure of the fastening means 23.

Any number of other modules, including the light fixture 14, outlet fixture 12, and switch fixture 13, can be connected to the exterior transition fixture 11 in series in any order and with as many of the modules repeated as necessary. If the fixtures have a rectangular shape, as depicted, the connection plug 24 and connection outlet 25 may be disposed on either the sides of the fixtures or on the ends of the fixtures, allowing the fixtures to be connected in either a side-by-side manner or an end-to-end manner, respectively. No claim is made as to the specific shape of the various fixtures, however. The various fixtures may have a circular, triangular, or any other shape, allowing them to be connected together and organized in a number of different configurations. Furthermore, no claim is made as to the specific number of connection plugs 24 and connection outlets 25 disposed on the sidewalls of the housings, allowing the modules of the present invention to be organized in an even greater number of configurations and orientations. Although the connections plugs 24 and connections outlets 25 of the various modules are intended to engage together, they are conventional power plugs and therefore any conventional electrical plug that can be inserted into a connection outlet 25 and a connection plug 25 can be inserted into any conventional outlet.

Each of the fixtures of the present invention utilizes standard A/C wiring, providing hot, neutral, and ground connections. Each of the hot, neutral, and ground connections from the various outlets and plugs of the present invention are connected together, forming a continuous, integrated electrical connection that is simultaneously powered through the exterior transition fixture 11. The electrical transition fixture 11 is connected to an electrical outlet located remotely from the location of the present invention. The present invention is convenient to use by a user because it allows users to have a group of outlets, light sources, and other devices powered by a single electrical connection, obviating the need for multiple power cords. Furthermore, the modularity of the present invention allows users to connect and disconnect modules as needed based on their current needs. In an alternative embodiment of the present invention, the connection plugs 24 and connection outlets 25 disposed on the housings of the various modules may be extendable, as with the extendable plug 18 disposed on the exterior transition fixture 11.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A modular electrical apparatus, comprising:

at least one exterior transition fixture having a transition fixture housing defined by at least one transition fixture sidewall, a transition fixture front face, and a transition fixture back face;

a transition fixture plug extending from said transition fixture front face;

a transition fixture switch disposed on said transition fixture back face;

a weatherproof cover hingedly attached to said transition fixture housing, said weatherproof cover adapted to cover said transition fixture plug;

a plurality of transition fixture outlets disposed on said transition fixture housing;

at least one outlet fixture having an outlet fixture housing defined by at least one outlet fixture sidewall, an outlet fixture front face, and an outlet fixture back face;

at least one outlet fixture connection plug extending from said at least one outlet fixture sidewall;

at least one outlet fixture connection outlet disposed on said at least one outlet fixture sidewall;

at least one outlet disposed on said outlet fixture front face;

at least one switch fixture having a switch fixture housing defined by at least one switch fixture sidewall, a switch fixture front face, and a switch fixture back face;

at least one switch fixture connection plug extending from said at least one switch fixture sidewall;

at least one switch fixture connection outlet disposed on said at least one switch fixture sidewall;

at least one switch fixture switch disposed on said switch fixture front face;

at least one light fixture having a light fixture housing defined by at least one light fixture sidewall, a light fixture front face, and a light fixture back face;

at least one light fixture connection plug extending from said at least one light fixture sidewall;

at least one light fixture connection outlet disposed on said at least one light fixture sidewall;

a light bulb engagement means disposed on said light fixture front face;

wherein said exterior transition fixture, said outlet fixture, said switch fixture, and said light fixture are removably connected to each other via said connection outlets and said connection plugs, forming a continuous apparatus.

2. The modular electrical apparatus of claim 1, further comprising a fastening means disposed on said transition fixture housing.

3. The modular electrical apparatus of claim 2, wherein said fastening means comprises a lip extending around the perimeter of said transition fixture, said lip having a series of tapped apertures extending therethrough.

4. The modular electrical apparatus of claim 1, further comprising a fastening means disposed on said outlet fixture housing.

5. The modular electrical apparatus of claim 1, further comprising a fastening means disposed on said switch fixture housing.

6. The modular electrical apparatus of claim 1, further comprising a fastening means disposed on said light fixture housing.

7. The modular electrical apparatus of claim 1, wherein said switch fixture switch is adapted to selectively control the powering of said fixtures connected directly or indirectly thereto and any electrical appliances connected directly or indirectly thereto.

8. The modular electrical apparatus of claim 1, wherein said plugs are three-prong plugs.

9. The modular electrical apparatus of claim 1, wherein said outlets are three-prong outlets.

10. The modular electrical apparatus of claim 1, wherein said transition fixture switch is adapted to selectively control the powering of said fixtures connected directly or indirectly thereto and any electrical appliances connected directly or indirectly thereto.

* * * * *